US007860265B2

(12) United States Patent
Gaudreault

(10) Patent No.: US 7,860,265 B2
(45) Date of Patent: Dec. 28, 2010

(54) DIAPHRAGM FOR FULL RANGE BOXLESS ROTARY LOUDSPEAKER DRIVER

(76) Inventor: John Joseph Gaudreault, 16314 Madison St., Omaha, NE (US) 68135

( * ) Notice: Subject to any disclaimer, the term of this patent is extended or adjusted under 35 U.S.C. 154(b) by 699 days.

(21) Appl. No.: 11/881,910

(22) Filed: Jul. 30, 2007

(65) Prior Publication Data

US 2009/0034780 A1 Feb. 5, 2009

(51) Int. Cl.
*H04R 1/00* (2006.01)

(52) U.S. Cl. ..... 381/423; 381/431

(58) Field of Classification Search ..... 381/152, 381/423, 431; 181/157, 161, 171, 173; 318/390.1–390.2
See application file for complete search history.

(56) References Cited

U.S. PATENT DOCUMENTS 1,821,547 A * 9/1931 Hartley ..... 181/157
3,573,397 A * 4/1971 Sawyer et al. ..... 381/398
4,564,727 A * 1/1986 Danley et al. ..... 381/162
4,763,358 A * 8/1988 Danley ..... 381/165
5,140,641 A 8/1992 Danley
5,191,618 A * 3/1993 Hisey ..... 381/165
5,317,642 A * 5/1994 Danley et al. ..... 381/182
5,825,901 A * 10/1998 Hisey ..... 381/165
5,872,853 A * 2/1999 Marquiss ..... 381/71.1
2007/0165886 A1* 7/2007 Topliss et al. ..... 381/152
2008/0247595 A1* 10/2008 Henry ..... 381/398

* cited by examiner

*Primary Examiner*—Curtis Kuntz
*Assistant Examiner*—Ryan Robinson

(57) ABSTRACT

The design of a diaphragm for a rotary loudspeaker driver that eliminates phase cancellation and therefore eliminates the necessity of a box to acoustically isolate the front sound from the back. The key element of the design of the diaphragm is to use a cross section of at least three equal sides. This allows for the long sides of the diaphragm to create essentially positive pressure only as it rotates and creates a very rigid structure. Further by sizing the cross section to the width of the highest frequency to be produced you allow for a nearly perfect 360 degree radiation at all frequencies.

1 Claim, 5 Drawing Sheets

DIAPHRAGM FOR FULL RANGE BOXLESS ROTARY LOUDSPEAKER DRIVER

CROSS REFERENCE TO RELATED APPLICATIONS

Not Applicable

FEDERALLY SPONSORED RESEARCH

Not Applicable

SEQUENCE OR PROGRAM LISTING

Not Applicable

BACKGROUND OF THE INVENTION

1. Field of Invention

This application relates to a device for the production of sound, specifically a radically new type of a rotary loudspeaker driver with a unique diaphragm.

2. Prior Art

Conventional drivers have a voice coil, constructed of windings of a conductive wire, attached to a diaphragm. The voice coil carries an electrical signal which creates a magnetic field. That field interacts with the magnetic field of a permanent magnet. The goal is to cause the voice coil and therefore the diaphragm to move in response to the frequency and amplitude of the electrical signal. The diaphragm moves the medium it is immersed in, typically air, and produces an output which is the acoustic analogue of the electrical signal.

In the case of a cone speaker or a dome speaker the voice coil wire is wound around a tube which extends perpendicular to the plane of the diaphragm. In the case of a planar magnetic driver the voice coil is embedded in or covers most of the surface of the diaphragm. The permanent magnets are held away from and parallel to the plane of the planar magnetic diaphragm.

In all cases, the cone and the dome and the planar magnetic drivers the diaphragm is held at its edge to a frame, also called a basket in the cone and in the dome speaker. Also attached to the frame are a permanent magnet and a set of pole pieces. The pole pieces serve to focus the magnetic field of the permanent magnet around and inside of the voice coil. This cavity formed by the magnets and the pole pieces is referred to as a magnetic gap.

In the design of the conventional cone driver a flexible and air-tight ring, called a surround, connects the large edge of the cone to the frame. The surround is often made of rubber or foam. A second smaller ring called the spider connects to the neck of the cone which is also where the voice coil attaches to the cone. The spider's function is to also center the voice coil in the magnetic gap and provide a spring function to return the cone assembly to its rest position or home position.

Traditionally the surround most always serves to acoustically seal the diaphragm to the frame and thus the diaphragm to a speaker baffle. The baffle is the mounting surface to which most driver(s) attach. The baffle is most always the front side of the loudspeaker box that encloses the back of the drivers. This whole loudspeaker box assembly being called a loudspeaker cabinet or a loudspeaker box.

The surround contributes to the reproduction of sound of each driver. The surround moves with the diaphragm. The surround by the nature of its function is of a different material from the diaphragm. It is elastic and its different acoustic properties will add its own acoustic character to the sound of the driver.

In traditional loudspeaker designs the loudspeaker box serves to modify and or control the back radiation from the driver. Traditionally the main function of the loudspeaker box is to keep the back radiation from meeting the front radiation in phase and canceling out all sound by destructive interference or phase cancellation. Planar magnetic speakers sometimes do without a loudspeaker box due to their sheer size which minimizes the said phase cancellation.

The boxes are a source of great expense in the construction of loudspeakers and consume millions of board feet of lumber. The boxes require much engineering to eliminate resonances and vibrations that they are prone to. The boxes are a major source of diffraction of sound waves off of the surface of the box and which serves to distort the sound waves.

In the planar magnetic design it is the edge of the diaphragm that is fixed to the frame. Therefore the diaphragm serves the double and contradictory function of being the rigid diaphragm and the surround that is flexible. The planar magnetic diaphragm moves more like a drum head than a piston. This nonlinear movement is minimized only by its large surface.

It is the very nature of the surround's elasticity that invites nonlinear movement when the diaphragm is moving. The thin and flexible diaphragms of loudspeakers flex while operating. When combined, the materials used for the surrounds and spiders and diaphragms these materials' nonlinearities are compounded. The whole system is often operating outside of the narrow linear envelope of accurate reproduction. These distortions are sometimes considered euphonic or non-irritating but are definitely distortions. The surround and the spider are flexible and are asked to perform the contradictory functions of providing spring and stiffness.

The flexing of traditional pistonic diaphragms is a result of designing for the thinnest and lightest materials to construct diaphragms. Thicker and therefore more rigid diaphragms are inherently more linear but put too large a mass burden on the surrounds of rubber and foam of the conventional cone and dome pistonic drivers.

The whole flexible cone diaphragm and surround and spider suspension system is an easily constructed and understood compromise which is the basis of the traditional design approach to sound production drivers. Its visual analogue to the ear drum has an immediate emotional appeal and is conceptually easy to understand for every school child.

ADVANTAGES

My driver eliminates the need for the loudspeaker box to isolate the negative back wave from meeting the positive front wave in phase and canceling out the sound wave. This also eliminates reflections of sound off of the loudspeaker box surrounding the driver—a major consideration. My driver design allows for a full-range range driver which is able to produce the lowest audible frequencies to the highest audible frequencies with a single driver. My driver will radiate sound at all frequencies from the low to the high frequencies in a cylindrical wave of 360 degrees in the horizontal plane and in a vertical plane equivalent to the height of the driver.

My driver eliminates the necessity for an elastic material to center the diaphragm in its home position. My driver allows for the use of a magnetic repulsion system for holding the diaphragm and the voice coil assembly in its home position while allowing the diaphragm to rotate in response to the electrical signal applied to the voice coil.

My driver eliminates the flexing of a traditional cone or dome driver due to my driver's diaphragm's geometry.

My driver uses bearings to fix the movement of the diaphragm and the voice coil in a perfect plane of movement as seen in FIG. 1A. Others who use such means can be seen in U.S. Pat. Nos. 4,763,358 to Danley (1998) and 5,140,641 to Danley (1992) and 5,317,642 to Danley (1994) and U.S. Pat. No. 5,825,901 to Hisey (1998).

SUMMARY

In accordance with the present design of a rotary loudspeaker driver diaphragm with a triangular, or higher order sided, cross section that eliminates phase cancellation. A driver design that is able to use a magnetic homing mechanism. A driver that can function as a full range driver and yet have a perfect horizontal polar response. A diaphragm that is rigid and has excellent transient response.

DRAWINGS

Figures

Figure 1A:
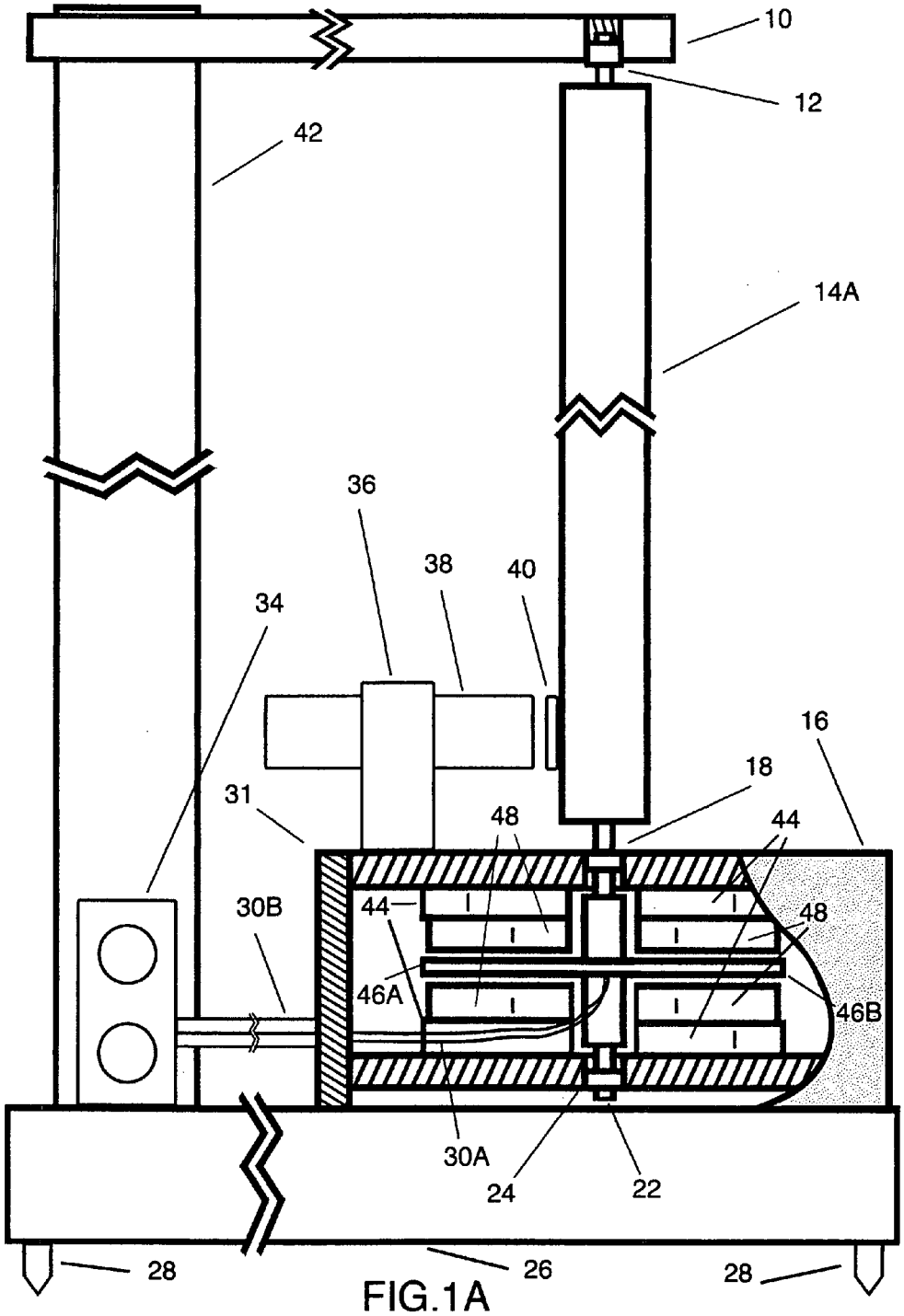
FIG. 1A Shows a side view of the first embodiment of my driver which includes a cross section of the motor frame.
Figure 1B:
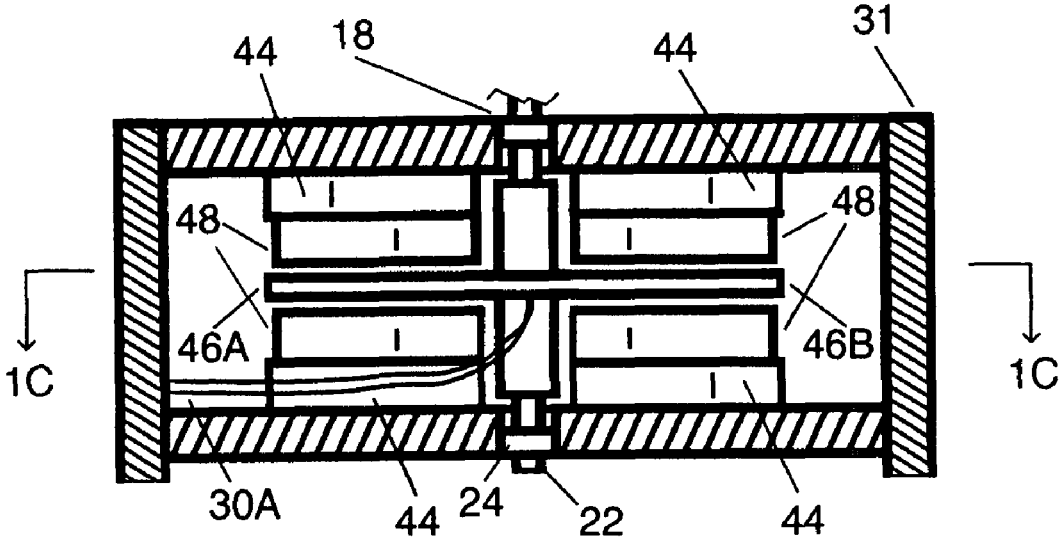
FIG. 1B Shows just the cross section of the motor frame of FIG. 1A with the air filter removed. There are indicators of a second cross section of motor frame.
Figure 1C:
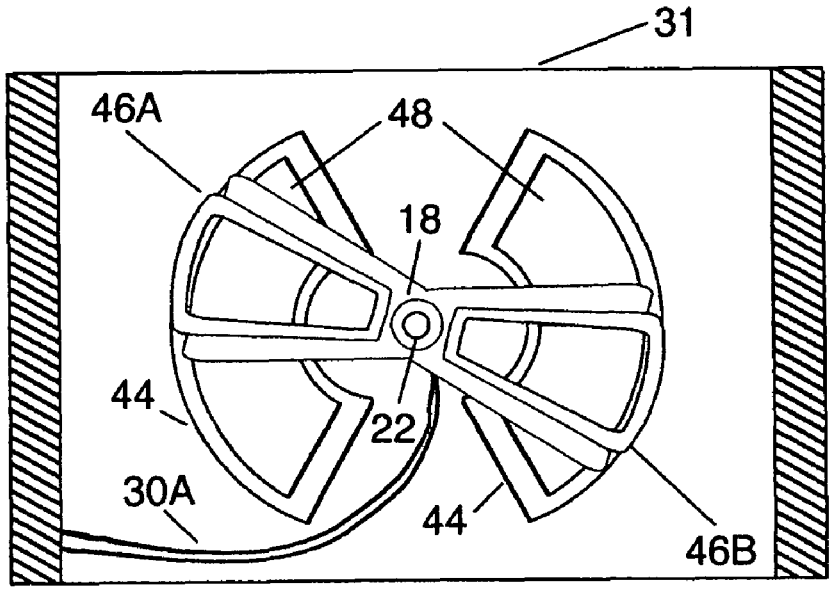

FIG. 1C Shows a second cross section of the motor frame from above. The top of the motor frame is removed as well as the top magnet and pole piece. The voice coils are shown from above.

Figure 2A:
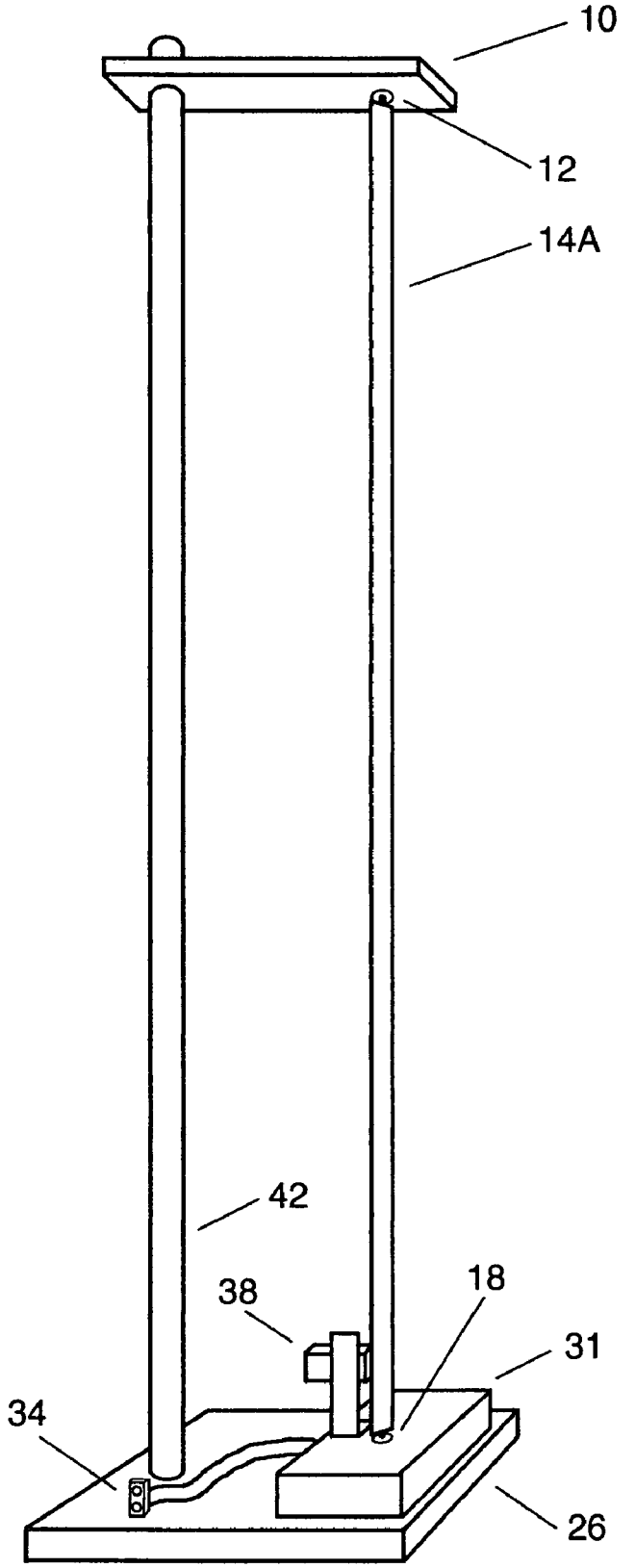

FIG. 2A Shown is a perspective view of the first embodiment of my driver.

Figure 2B:
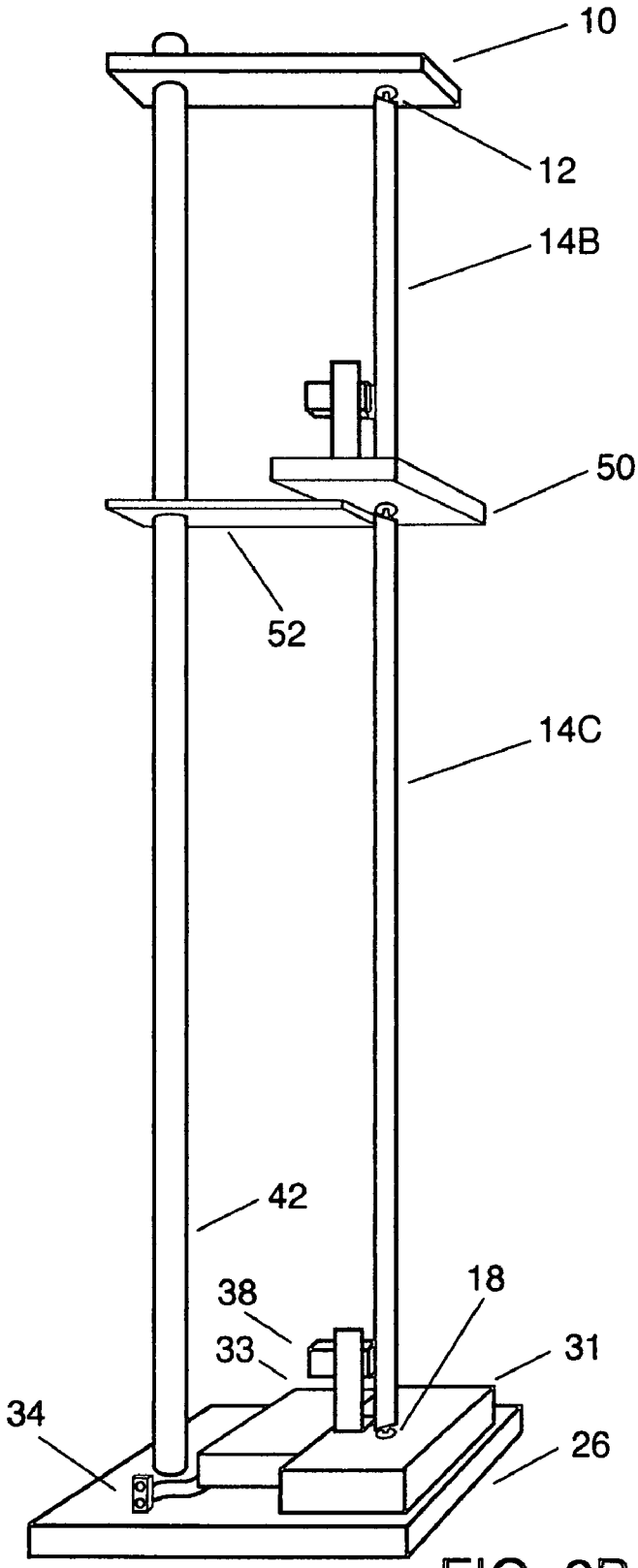

FIG. 2B Shown is a perspective view of another, second, embodiment of my driver in a tweeter/woofer arrangement with crossover.

Figure 3:
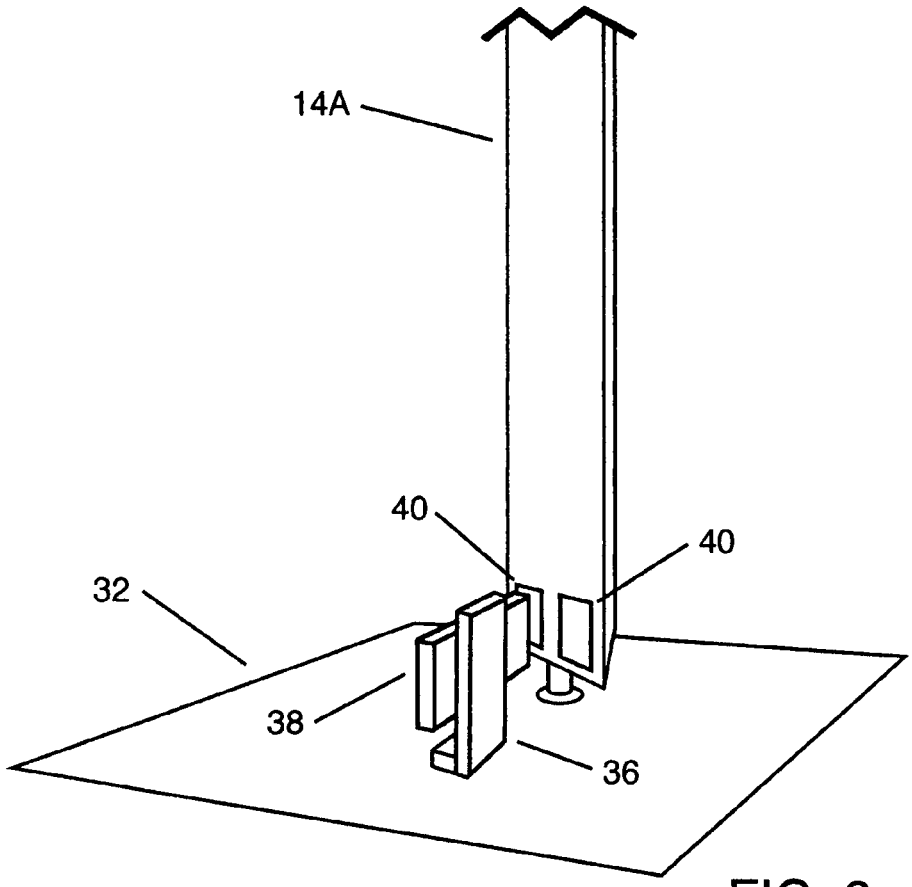

FIG. 3 Shown is a perspective partial illustration of the magnetic homing mechanism.

Figure 4A:
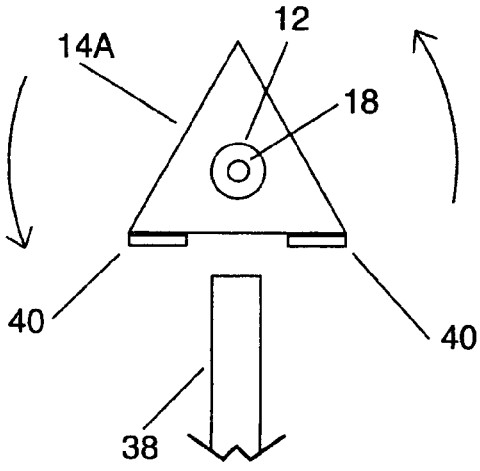

FIG. 4A Shown is an overhead partial illustration of the homing mechanism.

Figure 4B:
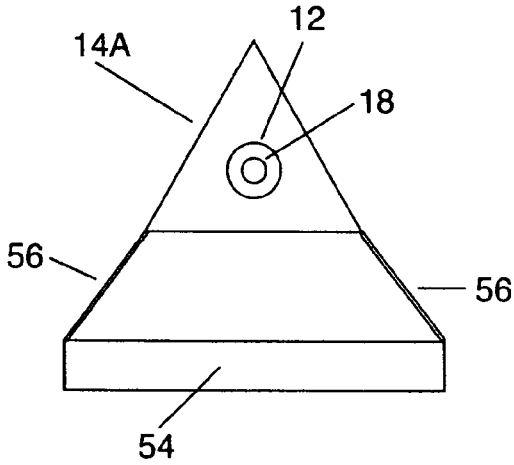

FIG. 4B FIG. 4A Shown is an overhead partial illustration of a homing mechanism based on elastic threads.

REFERENCE NUMBERS

10 top support arm
12 top bearing
14A diaphragm—full range
14B diaphragm—tweeter
14C diaphragm—woofer
16 air permeable filter
18 upper bearing
22 spindle
24 lower bearing
26 base
28 feet
30A wires—inside motor frame
30B wires—outside of motor frame
31 motor frame
32 top surface of motor frame
33 crossover box for two-way embodiment
34 speaker wire connectors
36 bracket for large homing magnet
38 large homing magnet on motor frame
40 small homing magnet on diaphragm
42 support mast
44 pole pieces
46A voice coil
46B voice coil
48 motor magnets
50 motor frame for tweeter
52 support bracket
54 bracket for fastening elastic threads
56 elastic threads for homing mechanism

DETAILED DESCRIPTION

In accordance with my driver the diaphragm is long and narrow FIG. 1A and FIG. 2A. The small ends having at the least a triangular cross section with long sides of equal length and width and short sides of equal length. Each long side is rectangle. All sides need to be equal to maintain an equal mass distribution around the axis of rotation. This assures linear motion of all rotating elements.

Experiments have shown that the diaphragm with a cross section of at least three equal sides has significantly higher efficiency of converting the electrical signal into sound than does the flat rectangular diaphragm. In experiments a triangular or square cross section, or higher even order, diaphragm nearly eliminates the phase cancellation inherent in the cone and the dome and the planar magnetic drivers. With embodiments that have at least three equal long sides (four sides, six sides, eight sides, etc.) the percentage of the diaphragm's surface that generates a positive acoustic output is nearly 100%. This is a significant increased over the rotating flat diaphragm which has significantly less positive acoustic output. If you plot the cross section of a three side, or higher order (even number of sides), cross section as it rotates about its center on top of a piece of graph paper it is immediately apparent that as the sides rotate about its center every point on the surface moves forward and thus contributes to a positive air pressure. There is no negative sound pressure generated to interfere with the positive pressure and cause phase cancellation as there are in all other types of diaphragm designs.

It is not just the greater surface area gained by three or more sides over the two sided diaphragm but the angle at which the sides of the diaphragm strike the medium and the path they trace as they pivot around the long axis. More area moves the more air and thus is more efficient. In this embodiment of my driver the air is moved 100% in phase. In the flat rotary diaphragm some volume of the air is moved much further at the outer edge than in near to the axis of movement. In my embodiment the difference in distance moved over a given side is essentially zero than it is for an equivalent movement of the flat two sided diaphragm. Therefore the sound generated across the width of a side of the diaphragm is in equal phase.

Some other rotating drivers, U.S. Pat. No. 4,763,358 to Danley (1988) U.S. Pat. No. 5,140,641 to Danley (1992) U.S. Pat. No. 5,825,901 to Hisey (1998), are designed to only function as a subwoofer driver. In this embodiment of my driver the diaphragm could have a cross section of a width equal to the width of the smallest wavelength or the highest frequency wished to be produce. By choosing such a width the diaphragm is able to radiate sound in 360 degrees from the lowest frequency to the highest frequency chosen for its range. This embodiment would have a perfect polar response over its operating range in the horizontal plane and would radiate sound in the vertical plane in a height equivalent to the diaphragm's height. This is know as a line source radiation pattern.

By acting as a line source in the vertical plane it would minimize the well know early ceiling and floor reflections which serve to muddy the sound generated in systems that have a wide vertical polar response. If I choose 18,000 cycles per second as the highest frequency that I wished to produce then the narrow width of a side of the diaphragm would be approximately 1.9 cm (three quarters of an inch). To match the surface area of a 15.24 cm (6 inch) diameter cone driver the diaphragm whose axial sides would require each side to have a width of 1.9 cm (three quarters of an inch) and a length of 121.92 cm (forty-eight inches). A 121.92 cm (six inch) diameter speaker is chosen as a target minimum size for a full-range driver in a typical listening room in a an average house.

This embodiment of my driver keeps most of the mass of the diaphragm near the axis of rotation. This driver minimizes the effect of the diaphragm's mass on the transient response of the diaphragm as it rotates. It minimizes the moment of inertia. A triangular cross section is the optimal mass to surface area diaphragm as a rectangular cross section where each side is the same width and which is the same width as a side of a triangular cross section would have one third more radiating surface but twice the mass. Also the triangular cross section would have 60 degree angle and the square cross section would have 90 degrees relative to the long axis of the diaphragm. This equates to a greater angle of attack for the triangular cross section and therefore greater efficiency in moving air.

One implementation of this driver would allow for the use of a standard rotary voice coil swing arm actuator to drive the diaphragm from the base end of the diaphragm. Other types of electric motors could be employed. It would allow for a 360 degree horizontal frequency response unencumbered by any structure other than a top support arm 10 and a support mast 42 FIG. 1A which supports and fixes the top end of the driver's diaphragm.

My implementation allows for the diaphragm to be very rigid and inflexible compared to the diaphragms of the cone and the dome and the planar speakers. The diaphragm that rotates is stressed by torsional forces which exerts much lower force than the tensile forces on the diaphragm that moves in a piston like fashion. The diaphragm of my driver can be nearly rigid in practice and does not exhibit the flexing of other dynamic driver diaphragms.

In my embodiment the rigid diaphragm which rotates is subject to marginal torsional forces but nearly no bending forces. The cone and the dome and the planar magnetic driver diaphragms are prone to flexing and bending. In my embodiment the diaphragm could be constructed of a thin and rigid and light foam core which could be faced with a thin skin of aluminum or carbon fiber composite or another light and rigid material. By the nature of the thickness of the diaphragm the torsional forces would be very minimal and far below the equivalent bending forces that the cone or the dome would be subjected to. The flexing of traditional pistonic diaphragms is a result of designing for the thinnest and lightest materials to construct diaphragms.

Thicker and therefore more rigid diaphragms are inherently more linear but put too large a mass burden on the surrounds of rubber and foam of the conventional cone and dome pistonic drivers. In a rotary driver most of the mass is kept close to the axis of rotation and maintains a low moment of inertia and has a high polar moment of inertia. Polar moment of inertia is a measure of an object's ability to resist torsion. In rotary design the heavier and stiffer diaphragm outperforms the lighter diaphragms because to its lack of flex and the geometry of its rotation about an axis.

One driver design, U.S. Pat. No. 5,317,642 to Danley (1994), described a driver as a rotary speaker that can function as a full-range driver in one embodiment. Its design provides for the diaphragm which is roughly triangular in shape and whose width gets larger from one end to the other. It has a slopping cross section for the purpose of providing equal polar response in the horizontal plane in the forward facing hemisphere of the driver. While this does provide for all frequencies to be radiated in a semicircular wavefront it is only so at one point along its vertical dimension for a given frequency whose width is smaller that that a given width of the diaphragm at one given point. All frequencies would not all of the time be radiated in a constant polar pattern but would be radiated unevenly across the horizontal plane in front of the driver.

In the embodiment of my driver all frequencies from the lowest to the highest in the target range would be radiated evenly in the horizontal plane in 360 degrees. My driver would exhibit no phase cancellation and would not require the loudspeaker box to prevent this as in the embodiment of U.S. Pat. No. 5,317,642 to Danley (1994) which would require the use of the loudspeaker box.

This embodiment of my driver is able to use, but is not limited to using, a magnet repulsion system to replace the elastic material used in most all other drivers to return the diaphragm and the voice coil to its rest or home position. See FIG. 1A where the magnet 38 is held in opposition to the magnet(s) 40. One or more small and lightweight but powerful rare earth magnets 40 would be fixed on a moving part of the driver. One or more large and very powerful permanent magnets 38 would be placed on the motor frame in physical opposition to the moving magnets. See FIGS. 3 and 4A. The same poles, whether North or South, of both magnets would face each other and then would repel each other. This magnetic repulsive force would hold the voice coils centered in the magnetic structure and serve to dampen and limit the travel of the voice coil the diaphragm.

In another embodiment of my driver the large permanent magnets 38 could be replaced by an electromagnetic magnet (not shown) hooked up to a feedback amplifier (not shown) to provide an active magnetic repulsive homing mechanism that tracks the electrical signal and provide an even finer control of forces to home diaphragm movement.

One more advantage of the system of bearing support and magnetic homing is that it does not contribute to the reproduced sound as does the surround on traditional speakers. A flexible material, as shown in FIG. 4A could be used by itself or in combination with other remedies such as the magnetic homing design. Elastic threads 56 connect an edge of the diaphragm to a bracket 54 on the motor frame top 32.

In my first embodiment the driver would operate across the full audio range—FIG. 2A. This other, second, embodiment could be implemented in a multiple driver application where two or more drivers are designed to divide the frequency range between the individual drivers to optimize efficiency and or transient response—FIG. 2B. A crossover 33 could be used to divide the frequency spectrum between the drivers. The driver intended for the higher frequencies 14B could be smaller and lighter while the driver reproducing the lower frequencies could be longer 14C.

To maintain the 360 degree radiation across all frequencies being reproduced the drivers reproducing the lower frequency range could have more sides and thence more surface area for a given height but would of course maintain a width for each side that is consistent with the width of the highest audible frequency that that particular driver will be reproducing. Alternatively each driver optimized for a limited frequency range could maintain the same side width but be longer for greater surface area and hence greater output. This multiple driver approach may be desirable when needing to reproduce higher volumes of sound but it will compromise the frequency polar response as well as the transient response of the system as a whole. A multiple driver system would also necessitate a crossover 33 system which would further degrade the frequency, polar and transient response over a full-range loud speaker driver.

Operation

FIG. 1A shows a side view of the first embodiment of my driver. The vertical diaphragm 14A would have a triangular cross section and be attached to bearings 12 and 18 at both the top and bottom of the diaphragm. Bearings 12 and 18 are attached to a spindle 22 to which are attached two voice coils 46*a* 46*b*. See FIG. 1B which is the complete motor, minus the magnetic homing and the filters on the side, from FIG. 1. See FIG. 1C which is an overhead cut away view taken from FIG. 1B at the plane indicated. This type of voice coil, a rotary voice coil swing arm actuator, is most often employed in modern hard drives to position the heads and in scientific instruments. Its operating parameters are well understood. In this implementation of my driver there are two opposed voice coils to balance inertial forces. In FIG. 1C the top of the motor frame 31 and the top pole pieces and the top magnets have been removed for clarity. The two bearings 24 and 18 are held in place by the motor frame 31 of rigid nonmagnetic material. The motor frame 31 serves as a support for the pole pieces 44 and the magnets 48 for the motor. The motor frame is fixed to a base 26. Offset from the diaphragm 14A and the motor frame 31 and fixed to the base 26 is a top support mast 42. Attached to the top support mast 42 is a top support arm 10 which is fixed to the top support mast 42 on one end and to the bearing 12 on the other end. The rigid structure created by the top support mast 42 and the top support arm 10 and the base 26 provides a rigid brace for the bearing 12 and therefore the top end of the diaphragm. The top support mast 42 bottom is fixed as far as the dimensions of the base 26 allows away from the bottom of the diaphragm 14A.

A large homing magnet 38 is held in place by a magnet bracket 36 and is fixed to the motor frame 31. A small homing magnet 40 is placed on the side(s) of the diaphragm 14A and whose pole faces the same pole of the large homing magnet 38 held in place by the bracket 36. A pair of wires 30A run from the voice coils to a set of plugs 34 on the base 26 for the attachment of speaker cables (not shown) from the output of an audio amplifier (not shown). A Wire 30B shows thick covered extensions of the wires 30A outside of the motor frame. A set of at least three feet 28 are fixed to the underside of the base 26 to prevent the base 26 from moving due to the inertial forces generated by the voice coil and diaphragm assemblies as they rotate. An air permeable filter 16 is attached to the open sides of the motor frame 31 to allow air circulation for cooling of the voice coils 46*a* 46*b* at the same time preventing particulate matter, especially ferrous material, from being drawn into the inside of the motor frame 31.

The electrical signal from the audio amplifier (not shown) is fed to the voice coils 46*a* 46*b* by means of a speaker cable (not shown) attached at the 34 speaker cable connectors. The electrical signal varies in frequency and amplitude. This signal causes a likewise varying magnetic field to be generated in the voice coils 46*a* 46*b* which interacts with the static magnetic fields of the permanent magnets 48 to move the diaphragm 14A that the voice coils 46*a* 46*b* are rigidly fixed. When moving under the force of the voice coils 46*a* 46*b* the diaphragm's 14A vertical surfaces sweep equally through the medium, in this case air, and reproduces the amplitude and frequency information in the electrical signal. When the long sides of the diaphragm 14A rotates it creates positive sound pressure as a consequence of the geometry of the diaphragm 14A. The whole surface of all of the long sides push equally against the surrounding air at the same time.

A second embodiment of my driver would allow for separate drivers which would be optimized to produce sound in separate discrete segments of the audible frequency range. See FIG. 2B for a tweeter and a woofer version. Such drivers could be designed for a specific frequency range by designing for a specific high frequency cut off in the horizontal polar response and also optimize the surface area and weight for the same frequency range. The diaphragm for the high frequencies, 5,000 cps to 18,000 cps would use a shorter length and lighter diaphragm 14B.

A driver to produce only the middle frequencies from 500 cps to 5,000 cps (not shown) would have a larger surface area. The small dimension of each side would be wider because it would only need a 360 degree polar response up to slightly higher than 5,000 cps crossover point where its high frequency response begins to diminish under the control of a crossover 33.

The driver for the low frequencies need only have sides with widths to accommodate a high frequency slightly higher than say 500 cps. The lower cut off for a woofer can tolerate a greater mass because the transient response requirements diminish as the high frequency response of a driver goes lower. The lower its highest frequency the slower it will have to rotate. These individual drivers could be stacked vertically to maintain the line source vertical polar response as in the full-range implementation.

FIG. 2 shows a full view of an embodiment of my driver design that is the full-range driver.

FIG. 3 and FIG. 4A shows an embodiment of my driver. It shows a possible arrangement for the homing magnets that center the voice coil diaphragm assembly.

FIG. 4B shows an embodiment of my driver. It shows a possible arrangement for the homing elastic threads that center the voice coil diaphragm assembly.

FIG. 2B shows a possible arrangement for an embodiment of my driver that has the woofer diaphragm 14C and the tweeter diaphragm 14B. Each diaphragm has its own motor 31 and 50. The tweeter motor frame is held in place by support bracket 52. The crossover box is at 33.

The electrical signal from an audio amplifier (not shown) would connect by speaker wires (not shown) to the speaker wire connectors 34. The wires 30A and 30B would connect the signal to the two voice coils 46A 46B. The voice coils 46A 46B are sandwiched between the permanent magnets 48. The signal in the voice coils 46A 46B creates an analogous magnetic field which interacts with the static magnetic field of the permanent magnets. This interaction results in the voice coil 46A 46B assembly and the attached diaphragm 14A to rotate moving the air to create an acoustic analogue of the electrical signal. Because of the diaphragm's cross section the sides parallel to the axis of rotation sweep the air and produce a positive pressure with no phase cancellation. Due to the width of the cross section the diaphragm is able to produce a nearly perfect 360 degree vertical polar response across its frequency range. There would be a mechanism to maintain the voice coils in their home position when no signal is present across the voice coils 46A 46B. This could be a magnetic repulsion system FIG. 4*a* or and elastic restraint system FIG. 4B or a combination of both.

CONCLUSION

My driver breaks with the past in that it allows for the full range speaker that radiates evenly across the audible frequencies in the horizontal plane. My driver represents a break with past inventions in that it allows for the driver which functionally does away with the phase cancellations of other designs and frees the driver from the necessity of the enclosing box and all of the drawbacks inherent in the loudspeaker box, including vibrations and buzzing and engineering costs and complexities and excessive use of natural resources and sound reflections from the outer box surface. My driver allows for the abandonment of the traditional surround and spider replacing them with the bearing system and a magnetic homing system while allowing for a traditional elastic homing system. My driver allows for, but is not limited to, the use of a traditional voice coil system, commonly called a rotary voice coil swing arm actuator, which has a long technical history and used in a variety of devices.

I claim:

1. A diaphragm for a rotary loudspeaker driver which radiates sound at all frequencies in its range in a 360 degree horizontal pattern and can function as a full-range driver or can be implemented as a limited frequency range driver and that eliminates phase cancellation (a) comprising the diaphragm structure with sides which have parallel and straight edges and the edges of each of these sides are parallel with the central axis of rotation, each of these sides being a simple rectangle, and the diaphragm's cross section has at least three equal sides and which is light and rigid (b) the diaphragm has a structure on both ends of its axis for attaching bearings and one or more electric motors to a rigid structure or frame (c) the diaphragm that has at least three sides and when rotated along its central axis creates a positive pressure in the surrounding medium on all sides parallel to the axis of rotation and is not subject to phase cancellation of front and back waves (d) the diaphragm in which the width of each side is equal to the width of the wavelength of the highest frequency that is to be radiated uniformly in the horizontal plane (e) whereby the diaphragm may radiate sound evenly at all frequencies within its range in a horizontal 360 degree pattern and vertically along its entire length.

* * * * *